United States Patent [19]

Peschel

[11] 4,189,672

[45] Feb. 19, 1980

[54] VARIABLE TRANSFORMER METHOD AND APPARATUS FOR PREVENTING SHORT-CIRCUIT CURRENT FLOW

[76] Inventor: Stanley G. Peschel, Brewster, N.Y.

[21] Appl. No.: 890,523

[22] Filed: Mar. 27, 1978

[51] Int. Cl.[2] ..... H01F 29/04

[52] U.S. Cl. ..... 323/43.5 R; 336/149

[58] Field of Search ..... 336/148, 149, 150; 323/43.5 R, 43.5 S, 57, 44 R

[56] References Cited

U.S. PATENT DOCUMENTS

| | | | |
|---|---|---|---|
| 3,041,563 | 6/1962 | Carlsen | 336/149 |
| 3,346,804 | 10/1967 | Ryu | 336/148 |
| 3,376,535 | 4/1968 | Gout | 336/149 |
| 3,436,709 | 4/1969 | Schapira et al. | 336/149 |
| 3,896,370 | 7/1975 | Manz | 323/43.5 R |

FOREIGN PATENT DOCUMENTS

| | | | |
|---|---|---|---|
| 1115811 | 10/1961 | Fed. Rep. of Germany | 323/43.5 R |
| 2611570 | 9/1977 | Fed. Rep. of Germany | 323/43.5 R |
| 1083128 | 1/1955 | France | 336/149 |

*Primary Examiner*—A. D. Pellinen

*Attorney, Agent, or Firm*—Parmelee, Johnson, Bollinger & Bramblett

[57] ABSTRACT

In a variable transformer, two high-conductivity brushes are mounted in a carriage and adapted for longitudinally traversing the transformer winding to contact exposed segments of the winding. By relatively elevating and exposing the odd and even turns along two different traverse paths, contact with the individual odd and even turns is obtained by the dual brush system without short-circuiting adjoining turns, the brushes being interconnected through an external current-limiting or compensating circuit. Spacings between exposed segments of the winding along these respective traverse paths are filled with dielectric material and are wider than the high-conductivity brushes; thus these brushes can never short circuit adjacent turns. The brushes are positioned so that at all times at least one of them contacts an exposed winding segment. Potential differences between exposed winding segments contacted by respective brushes are offset by the voltage difference compensating circuit, such as a diode circuit, connected between the brushes, whereby no turn-to-turn current can flow, irrespective of the external load conditions being applied to this compensating circuit. The winding or windings are advantageously closely coupled to the magnetically permeable core, thereby minimizing leakage flux and associated leakage reactance. Very large size variable transformers now become feasible by employing this invention.

21 Claims, 29 Drawing Figures

VARIABLE TRANSFORMER METHOD AND APPARATUS FOR PREVENTING SHORT-CIRCUIT CURRENT FLOW

BACKGROUND OF THE INVENTION

This invention relates to variable electromagnetic apparatus and more particularly to transformers having means for varying the number of effective turns of the transformer winding or windings.

The usual variable transformer in the prior art has a brush mounted for movement along the length of a winding in the transformer to contact exposed segments of each turn of the winding. By selectively positioning the brush along the winding and by connecting that brush to an output circuit, the effective number of turns in the transformer can be varied, thereby varying the potential at the output. A portion of such a prior art variable transformer is schematically illustrated at 30 in FIG. 1. A core 32 of magnetically permeable material, such as laminated transformer iron, a portion of which is shown, defines at least one loop for magnetic flux to follow. A portion of a winding 34 is shown with turns encircling the core 32. This winding is an output or secondary winding of the transformer, and it may also serve as the input or primary winding, depending on the type of transformer. Changing magnetic flux in the core produces an electromotive force (emf), an electric potential difference, between each turn. The potential differences between turns is cumulative along the length of the winding.

For purposes of clarity, the winding 34 is shown as a line drawing, while the actual cross-section of each turn of the winding is only shown to the right of FIG. 1 at 36. The winding 34 is typically of enamel or varnish insulated copper wire having a square (or rectangular) cross-section as shown. In order to vary the output voltage from the transformer 30, a conductive brush 38 is mounted for movement along the length of the winding, i.e. along a traverse path, so as to contact exposed segments 36 of each turn of the winding. The output voltage is thus dependent on the position of the brush 38 in its traverse path along the winding.

In some positions of the brush in FIG. 1 it may be in contact with only a single winding, depending upon the relative size of the brush as compared to the winding segments 36. However, as shown, the brush may be positioned between two adjacent turns of the winding and thus form an electrical bridge between two turns (and in some prior art variable transformers three turns may become bridged). The exposed segments 36-1 and 36-2 of these adjacent turns, which would otherwise be at different potentials, are thus short circuited by the brush 38. With such a short-circuiting condition a brush of high electrical conductivity would permit a dangerously high current to flow in the turn of the winding defined between the short-circuited segments 36-1 and 36-2. This exceptionally high current would result in excessive heating of the closed winding turn or conductor loop, causing the transformer to self-destruct.

Two prior art techniques are conventionally simultaneously employed to avoid self-destruction of a variable transformer when a brush is positioned in a bridging relationship with two (or more) adjacent turns. First, rather than using a high-conductivity brush, a carbon brush 38 having a relatively high specific resistivity is generally used. The electrical resistance of such carbon brushes serves to limit the current flowing through the closed loop of the bridged turns. Although the so-called "short-circuit current" is thus limited, the high resistance of the carbon brush itself results in electrical losses as well as heating of the brush. The necessity for dissipating the heat generated in the carbon brushes leads to practical problems in designing prior art transformers with high power outputs. Consequently, generally there is a practical upper limit in the size of commercially available variable transformers, namely about 10 KVA per transformer unit. Where larger electrical loads are to be energized, a number of such relatively small prior art units are used simultaneously, and these units are spaced to permit dissipation of heat.

The use of such numerous relatively small prior art variable transformer units for supplying large electrical loads is cumbersome, expensive and wasteful of materials and space, but that is the conventional prior art arrangement.

In addition to the use of carbon brushes, past variable transformers have been manufactured with loose magnetic coupling between the winding and core, that is, the winding is relatively widely spaced from the magnetically permeable core. This loose coupling results in leakage flux illustrated at 40 in FIG. 1, which produces leakage reactance. The leakage reactance, along with the resistance of the carbon brush, serves to limit current flow through a short-circuited turn or turns. The reactances of the many loosely coupled turns have an overall deleterious cumulative effect on the output of the prior art transformer, resulting in undesirably poor regulation of the transformer output voltage.

Moreover, the amount of accumulated leakage reactance in such a prior art variable transformer depends upon the position of the brush along its traverse path. Consequently, the poor voltage regulation characteristics of such a transformer change as the brush is adjusted in its position leading to problems in use.

Furthermore, the relatively large leakage reactances of prior art variable transformers cause electrical losses and result in inefficient utilization of the materials from which the transformer is constructed, mainly transformer iron and copper.

It is among the objects of this invention to provide a variable transformer which provides for variable output by varying the effective number of turns in the transformer winding without short circuiting any turns in the winding and without interrupting the output voltage.

Among the many advantages of the present invention are those resulting from the fact that by eliminating the possibility of short-circuiting turns of the winding, brushes of high electrical conductivity may be used, and the winding may be closely coupled to the core, thereby increasing efficiency and improving output voltage regulation.

SUMMARY OF THE INVENTION

According to the invention in one of its aspects, segments of the transformer winding are exposed along the length of the winding with dielectric material filling the spacings between adjacent exposed segments. First and second brushes of high-conductivity material traverse along at least one traverse path past exposed segments of the winding with, at all times, at least one of the brushes contacting an exposed segment but with no single brush at any time simultaneously contacting two exposed segments of the winding. The high conductivity brushes result in efficient electrical operation with low losses in the brushes themselves.

According to the invention in another of its aspects, every other turn of the winding is exposed along a first traverse path of the first brush and every alternate turn of the winding is exposed along a second traverse path of the second brush. The spacings between segments along the traverse paths are greater than the widths of the respective brushes.

According to yet another aspect of the invention, segments of the winding are exposed by elevating segments of odd turns along one traverse path and segments of even turns along another traverse path, those segments being elevated relative to the rest of the winding and removing insulation from each of the elevated wire segments.

According to the invention in yet another of its aspects, the voltage potential differences between segments contacted by respective brushes are offset by a compensating electrical circuit interconnecting the two brushes.

In accordance with other aspects of the invention, the transformer winding and the two brushes themselves may be each formed of copper of square (or rectangular) cross-section, and the winding is efficiently closely coupled to the core.

BRIEF DESCRIPTION OF THE DRAWINGS

The foregoing and other objects, features, and advantages of the invention will be apparent from the following more particular description of preferred embodiments of the invention, as illustrated in the accompanying drawings, in which like reference characters refer to the same parts throughout the different views. The drawings are not necessarily to scale, emphasis instead being placed upon illustrating the principles of the invention.

DESCRIPTION OF PREFERRED EMBODIMENTS

Figure 1:
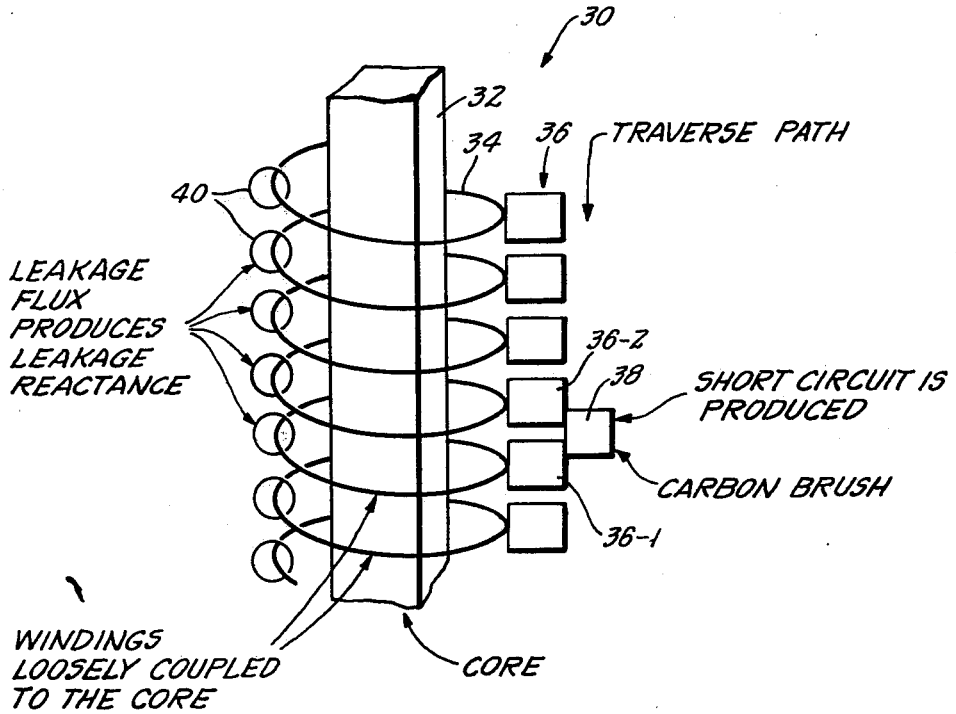
FIG. 1. PRIOR ART
FIG. 1 is an illustration of a portion of a prior art variable transformer to which reference has already been made.

A two winding, variable transformer 42 embodying the invention is shown in FIGS. 2 through 6. The transformer comprises a magnetically permeable core 44 formed of conventional iron laminations and providing a loop for magnetic flux to follow. The core is positioned between core seats 46 and 48 fixed to the supporting base 50 and upper core frame 52, respectively. The core 44 is clamped between the base 50 and frame 52 by two bolts 54 and 56, which also serve as guide rods, as will be explained further below. First and second windings 58 and 60 encircle respective vertical legs of the core 44 with the core winding window 61 therebetween. Segments 62 of odd turns of the first winding 58 are electrically exposed on the front of this winding along a first traverse path 63 for the winding 58. Similarly, exposed segments 64 of odd turns of the second winding 60 define a first traverse path 65 along the front of that winding.

Figure 4:
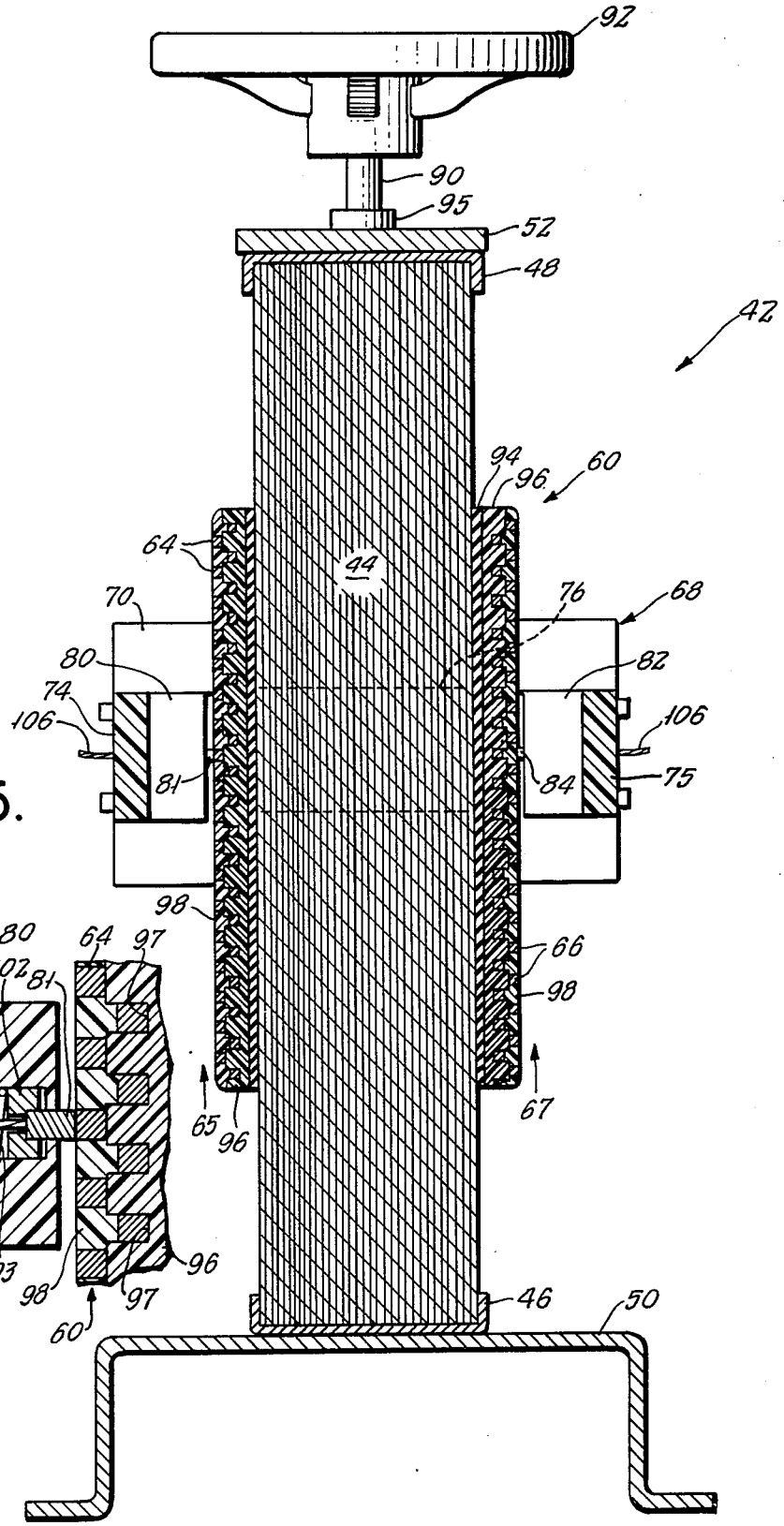
FIG. 4 is a cross-sectional view of the transformer of FIGS. 2 and 3 taken along line 4—4 in FIG. 3 and showing a brush positioned in a carriage on either side of a winding.

Along the rear face of each winding 58 and 60 (FIG. 6) even turns of the respective windings are exposed to define respective second traverse paths. For example, as shown in FIG. 4, segments 66 of even turns are exposed along the second winding 60 to define a second traverse path 67.

A movable carriage 68 surrounds both windings and is adapted for vertically traversing the windings. The carriage 68 includes plates 70 and 72 of dielectric material at either end thereof, which end plates are joined by front and rear carriage chassis members 74 and 75 (FIGS. 2, 3, 4 and 6) of dielectric material. The front and rear chassis members 74 and 75 are joined by a center carriage chassis member 76 of dielectric material which extends through the winding window 61.

Figure 6:
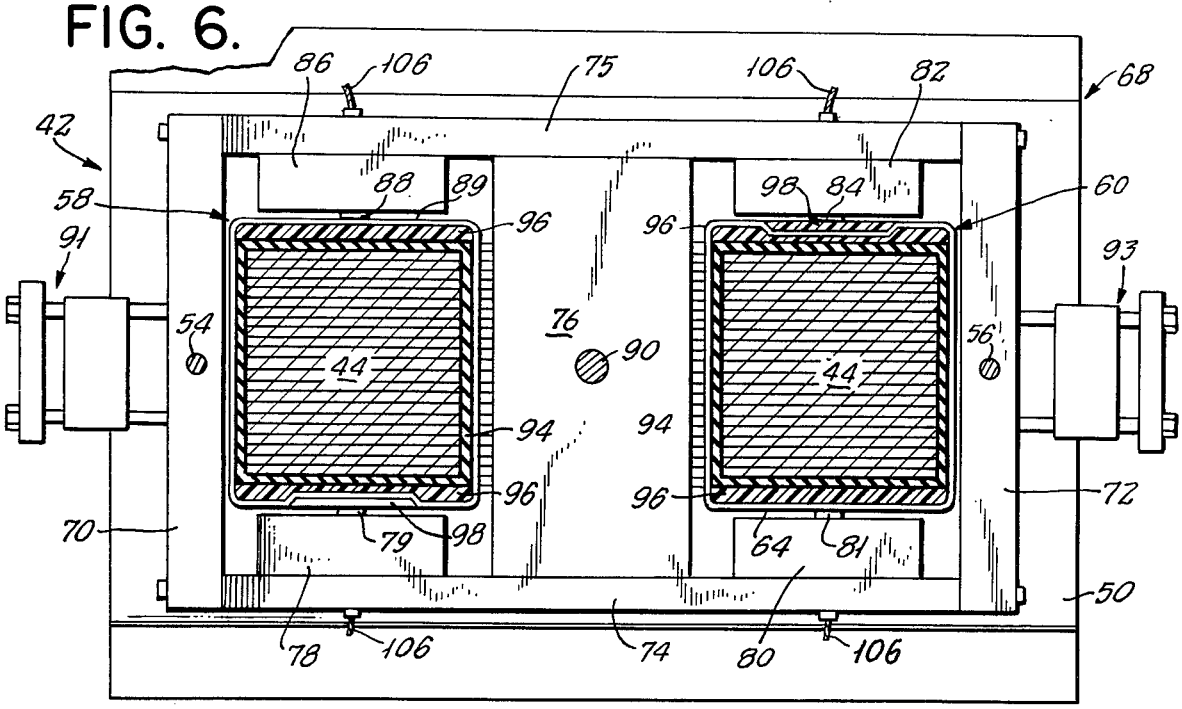
FIG. 6 is a cross-sectional plan view taken along line 6—6 of FIG. 3 and showing the winding and laminated core in cross-section.

Each of the front and rear chassis members 74, 75 carry two brush mounts positioned adjacent respective traverse paths. As best shown in FIG. 6, the front chassis member 74 carries brush mounts 78 and 80 and the rear chassis member 75 carries brush mounts 82 and 86. Each brush mount carries an electrically conductive brush which is pressed against a respective winding for contact with exposed segments of the winding. First brushes 79 and 81 are carried by the respective brush mounts 78 and 80 and are positioned for contacting exposed segments along the first traverse paths 63, 65 (FIGS. 2 and 3) of the respective windings 58 and 60. And brush mounts 82 and 86 fixed to the rear chassis member 75 carry second brushes 84 and 88 positioned for contacting exposed segments along the second traverse paths for the respective windings 58 and 60.

Figure 3:
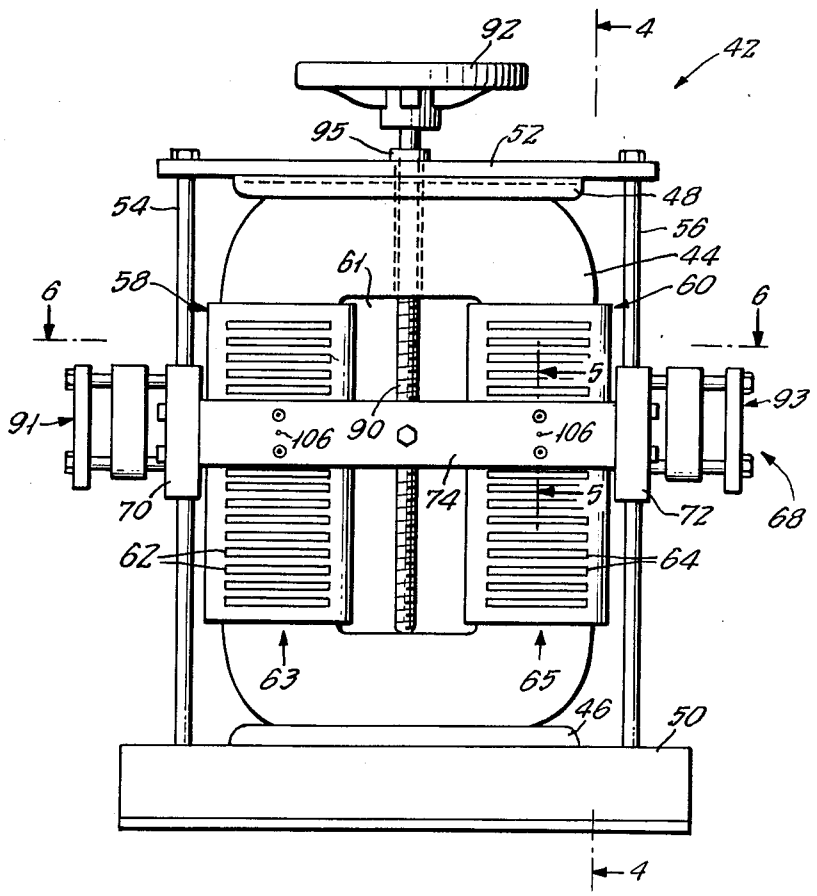
FIG. 3 is a front elevational view of the transformer of FIG. 2.
Figure 2:
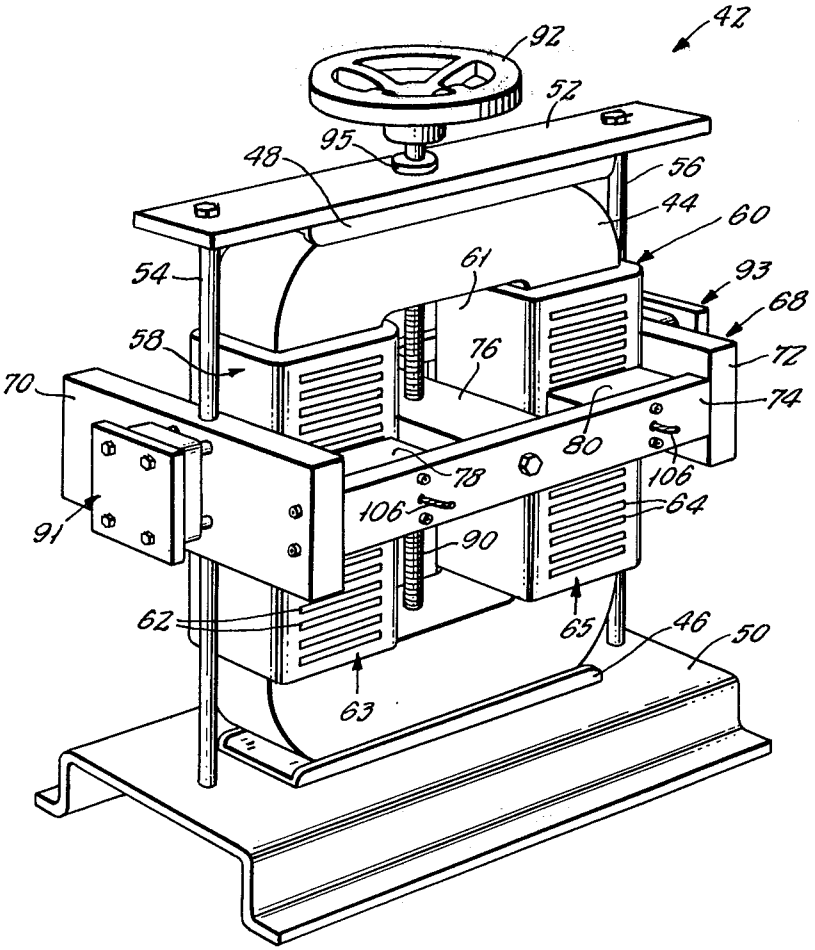
FIG. 2 is a perspective view of a dual-winding variable transformer embodying the invention and having a brush mounted for movement along opposite sides of each winding, i.e. along the front and back.

For elevating and lowering the carriage 68 along the windings 58 and 60, a lead screw 90 extends through at least the upper core frame 52, core seat 48, and core 44, and also through a threaded hole through the center chassis member 76. Vertical movement of the lead screw 90 relative to the core is prevented by a bearing mount 95 (FIGS. 2 and 3). Thus, as the lead screw 90 is turned, as by a hand wheel 92, the carriage 68 is elevated or lowered relative to the core and windings. The carriage is guided at either end by bolts 54 and 56 which extend through bushings in the end plates 70 and 72 to serve as guide rods.

Circuit supports 91 and 93 mounted to the carriage plates 70 and 72 for supporting voltage offset compensating means to be described later.

Details of the core 44 and the winding 60 are best shown in FIGS. 4 through 7. Each vertical leg of the laminated core 44 is surrounded by an insulating layer 94. A dielectric support member 96 is positioned over the insulating layer along each traverse path. Each dielectric support member has a plurality of transverse slots 97 (FIGS. 5 and 7) therein. Each slot is of sufficient width to accept a segment of a single turn which is depressed into that slot. And the slots are regularly spaced along the traverse paths to receive depressed segments from every other turn of the winding. Thus, after the winding has been wound about the support, segments of the even turns are pressed down into the respective slots 97 along the first traverse path, thereby relatively elevating segments of the odd turns, (or vice versa the odd turn segments can be depressed, relatively elevating segments of the even turns). Then, segments of the odd turns are depressed into the slots along the second traverse path, thereby elevating even turns (or vice versa).

Once the winding is wound about the dielectric support 96 and the insulating layer 94, it is covered with a dielectric potting material 98 along each traverse path. After hardening of the potting material, the potting material and the outermost insulation on the elevated segments of the winding are milled away for electrically exposing the elevated segments 62, 64, 66 and 89 along the respective traverse paths. The exposed segments are thus separated by spacings filled with dielectric potting material 98 covering the depressed turns.

Figure 5:
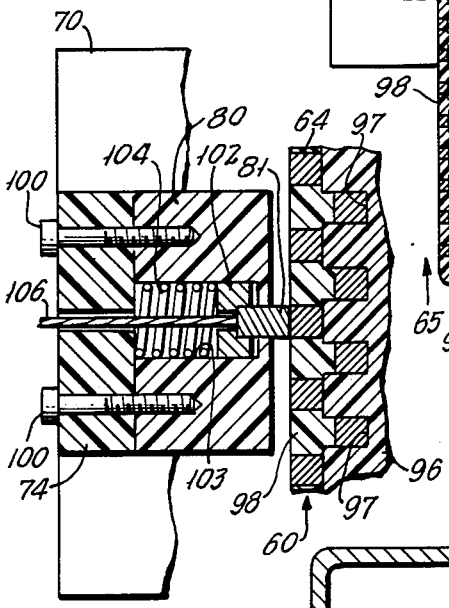
FIG. 5 is a cross-sectional elevational view of a high-conductivity brush positioned against an exposed segment of the winding and taken along line 5—5 in FIG. 3.

An example of one of the four brush mounts 78, 80, 82 and 88, i.e. mount 80, is shown in section in FIG. 5. The brush mount 80 is formed of dielectric material and is mounted to the front chassis member 74 by bolts 100. The high-conductivity brush 81, which may be a short length of the copper wire of the same cross-section as the wire forming the winding, is set in a brass brush holder 102, for example by soldering into a socket in this brush holder. The brush holder is movable along a bore 103 in the mount and is spring biased toward the winding 60 by a compression spring 104. A flexible braided or stranded wire lead 106 provides the electrical connection between brush 81 and an external circuit. Brush mount 80 and chassis member 74 are formed of dielectric material to electrically isolate the brush from all but exposed segments of the winding and the wire 106 and to avoid induced current losses.

Figure 7:
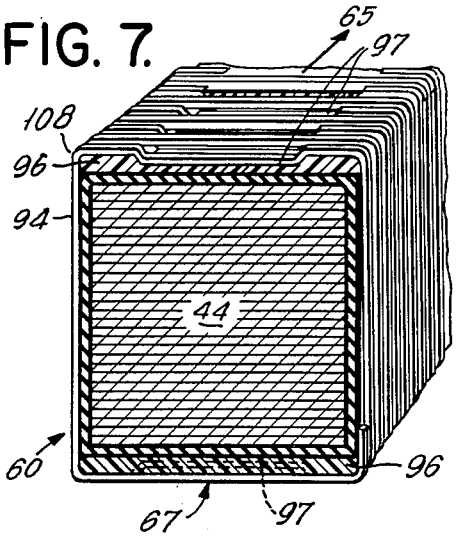
FIG. 7 is an isometric sectional view showing the winding as in FIGS. 2 through 6 around a laminated core, but before potting material is applied.

FIG. 7 shows a portion of the winding and core before the potting material 98 is applied. Again, the core 44 is surrounded with an insulating layer 94. The dielectric support 96 covers the traverse path sides of the insulating layer. Each dielectric support 96 has a line of spaced transverse slots 97 therealong, each slot having a width slightly greater than the width of the enamel insulated wire 108 used in the winding. The slots are spaced by a distance about equal to the width of the wire so that the slot spacing corresponds with the pitch of the winding. Thus, when the wire 108 is wound about the insulating layer 94 and dielectric supports 96, segments of it can be depressed into the slots at, for example, even turns for the first traverse path and held away from the insulating layer 94 in an elevated position at odd turns. The potting material 98 (FIG. 5) is then applied to fill in over the depressed segments of the winding. Finally, the potting material and the enamel insulation covering the elevated segments are milled down to electrically expose the elevated segments.

Instead of forming the dielectric support with a plurality of transverse slots 97, it may be formed with one or two longitudinal channels or grooves providing clearance into which segments of the winding can be depressed.

In the actual manufacturing process, the insulating layer 94 may be sufficiently rigid in tubular form to permit winding of the wire 108 onto this insulating layer which is supported by a removable mandrel without the core 44 being present. The mandrel is removed from within the completed winding. Then, in a conventional fashion, two U-shaped sections of the core 44 may be inserted into the hollow windings to complete the core structure.

Figure 8:
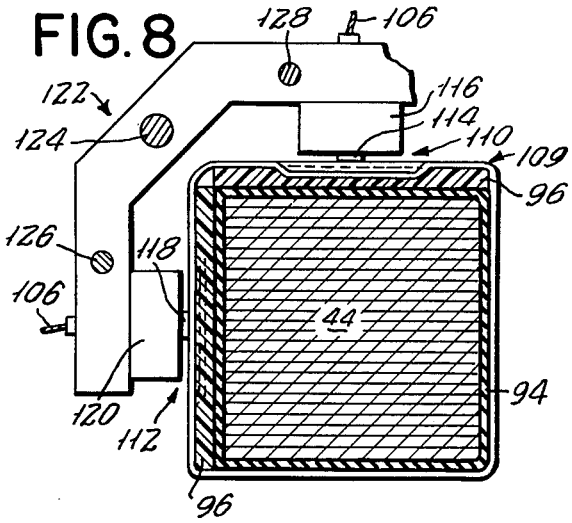
FIG. 8 is a sectional view of a winding and core with the traverse paths of the two brushes being along two adjacent sides of the winding, i.e. along the front and one side, in accordance with an alternative embodiment.

FIG. 8 shows an alternative arrangement of the first and second traverse paths using two dielectric support members 96. In this embodiment, a first traverse path 110 is, for example, along the front face of a winding 109, and a second traverse path 112 is on the adjacent face of the winding. As before, the odd turns of the winding are exposed along the first traverse path 110 and the even turns of the winding are exposed along the second traverse path 112 (or vice versa). A brush 114 of high-conductivity material extending from a brush mount 116 is positioned for movement along the traverse path 110 to contact exposed segments of the odd turns. And a second high-conductivity brush 118 extending from a brush mount 120 is positioned for movement along the traverse path 112 to contact exposed segments of even turns. Both mounts 116 and 120 are supported by a movable carriage 122 which in this case is generally L-shaped as seen in plan, such as a corner beam. The carriage 122 is caused to traverse along the winding by means of a lead screw 124, and the carriage is guided by guide rods 126 and 128.

Figure 9:
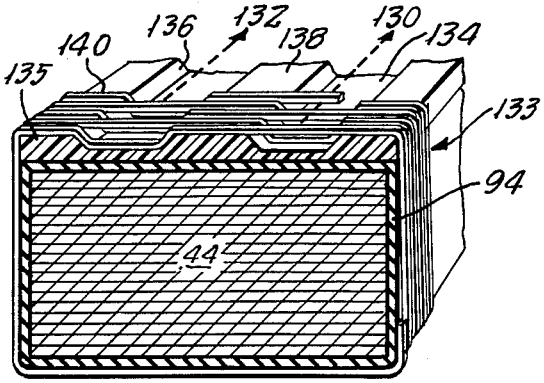
FIG. 9 is an isometric sectional view of another alternative embodiment of the invention with the first and second traverse paths being along a single side of the winding, i.e. both traverse paths are along the front side in spaced parallel relationship.

Yet another arrangement of the traverse paths is shown in FIG. 9. In this embodiment, the two traverse paths 130 and 132 are positioned in spaced parallel relationship extending along one face (the front side) of the transformer winding 133. Two grooves 134 and 136 are formed in a single dielectric support member 135 and extend the entire length of the winding 133. These grooves or channels define an intervening ridge 138 which also extends the length of the winding. In winding the wire 140 to form the winding 133 about the insulator layer 94 and dielectric support 135, unsupported segments of even turns are depressed into channel 134 and unsupported segments of odd turns are depressed into channel 136. However, odd turns span the groove 134 in an elevated position and even turns span the groove 136. Then, potting material, not shown, is applied to the traverse path side of the winding to embed the depressed portions of the wire along the respective grooves. The potting material and enamel wire insulation are thereafter milled down to expose the elevated wire segments along the two traverse paths 130 and 132. This side-by-side arrangement of the traverse paths is particularly suitable with relatively thin transformer wire which can be reasonably easily bent and depressed into the neighboring channels 134 and 136.

Figure 10:
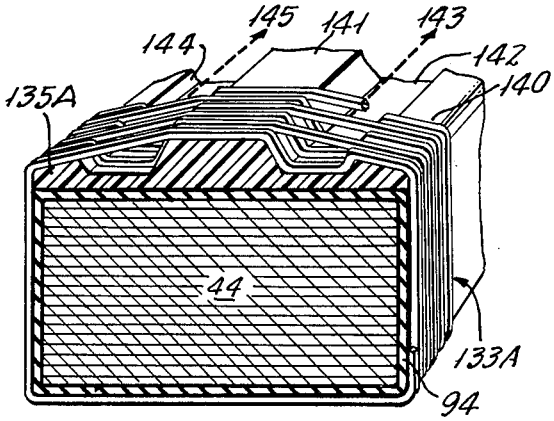
FIG. 10 is an isometric sectional view of yet another embodiment of the invention in which the parallel traverse paths are formed on either side of a raised longitudinal dielectric support.

FIG. 10 shows an embodiment of the invention in which the two parallel traverse paths 143 and 145 are on opposite sides of a raised ridge 141 of a dielectric support member 135A on a single face (the front side) of the winding. In a manner similar to that discussed with respect to FIG. 9, even turns are depressed in a groove or channel 142 along traverse path 143 and odd turns are depressed in groove or channel 144 along traverse path 145. Again, potting material is applied and milled to expose the relatively elevated segments of the winding 133A. As in the case of FIG. 9, this side-by-side traverse path arrangement shown in FIG. 10 is more practicable when the wire 140 of the winding 133A is of such a size as to be relatively readily bent and depressed into the channels 142 and 144 on either side of the intervening ridge 141.

Figure 11:
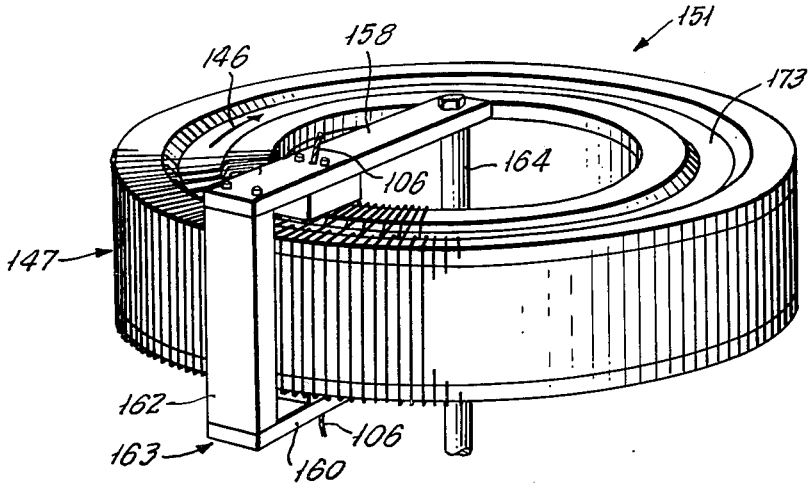
FIG. 11 is a perspective view of another embodiment of the invention having a toroidal core and winding, and circular traverse paths on the upper and lower sides thereof, i.e. on two opposite sides of the winding.
Figure 12:
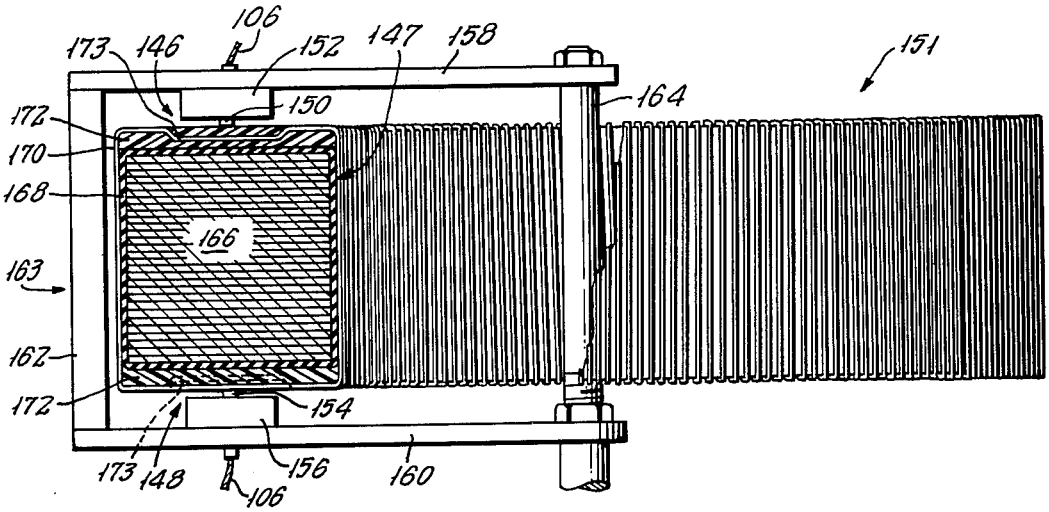
FIG. 12 is a side view, partially in section, of the toroidal transformer of FIG. 11.

In the embodiment shown in FIGS. 11 and 12 continuous traverse paths 146 and 148 are provided on opposite radially extending faces of a toroidal winding 147. A first brush 150 extends from a brush mount 152 to contact exposed segments of the winding 147 along the first traverse path 146 and a second brush 154 extends from the brush mount 156 to contact exposed segments of the winding along the second traverse path 148. The brush mounts 152, 156 are respectively fixed to chassis members 158 and 160 which are joined at their outer ends by an end plate 162 to form a revolving carriage 163. The carriage is fixed to a center rod or post 164 which can be turned to revolve the brushes along their respective traverse paths along the toroidal transformer 151. As with the rectangular shaped core transformers, the toroidal transformer includes a magnetically permeable core 166 of suitably laminated transformer iron surrounded by an insulating layer 168. A wire 170 is wound around the insulating layer 168 and dielectric support members 172 to form the winding 147. A dielectric support 172 may include either a continuous circular groove or channel 173 concentric with the axis of the pivot post 164, or a multiplicity of short radial slots arranged in a circular pattern may be used to receive the depressed segments of alternate turns of the winding 147. The revolvable chassis members 158 and 160 and the end plate 162 are formed of dielectric material for electrically insulating the brushes 150 and 154 and for avoiding induced current losses in the carriage 163. The brushes 150 and 154 are formed of high-conductivity material.

Figure 13:
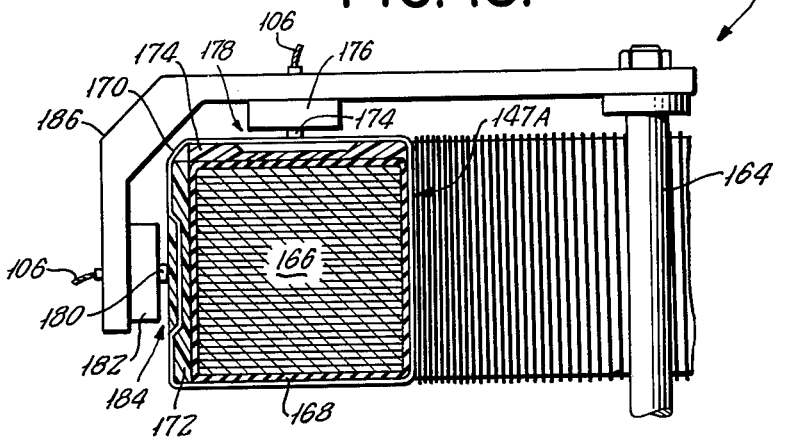
FIG. 13 is a partial sectional view of a toroidal transformer, but with the traverse paths on the upper and outside surfaces of the winding, i.e. on two adjacent sides of the winding.

As shown in FIG. 13, the traverse paths may extend along the upper and outside faces of a toroidal transformer 151A. A first high-conductivity brush 174 extending from a brush mount 176 is adapted for traversing a first traverse path 178 along which segments of odd turns are exposed and a second high-conductivity brush 180 extends from a brush mount 182 for traversing the second traverse path 184 along which even turns are exposed. Both brush mounts 176 and 182 are fixed to an L-shaped corner beam 186 fixed to the center rod or post 164. As before, rotation of this center post 164 causes the brushes 174 and 180 to revolve along their respective traverse paths.

Figure 14:
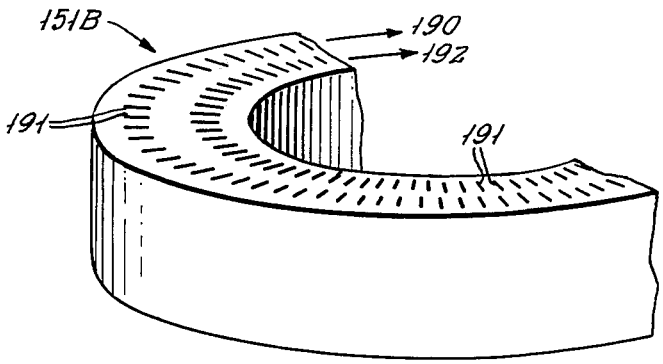
FIG. 14 is a perspective illustration of a toroidal transformer having side-by-side traverse paths on the upper surface of the winding.
Figure 15:
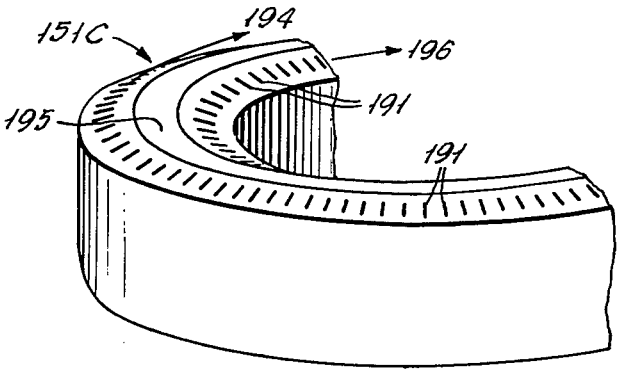
FIG. 15 is a perspective illustration of a toroidal transformer having traverse paths on either side of a raised dielectric support, similar to the arrangement shown in FIG. 10.

Toroidal transformer embodiments 151B and 151C analogous to the straight winding embodiments of FIGS. 9 and 10 are illustrated in FIGS. 14 and 15, respectively. In FIG. 14, first and second spaced, concentric traverse paths 190 and 192 are on a single radial face of the toroidal winding. In FIG. 15, first and second concentric traverse paths 194 and 196 are positioned on one face of the winding and on either side of a raised ridge region 195. In FIGS. 14 and 15 the exposed segments of the winding along the respective traverse paths are shown by the heavy lines 191.

Figure 16:
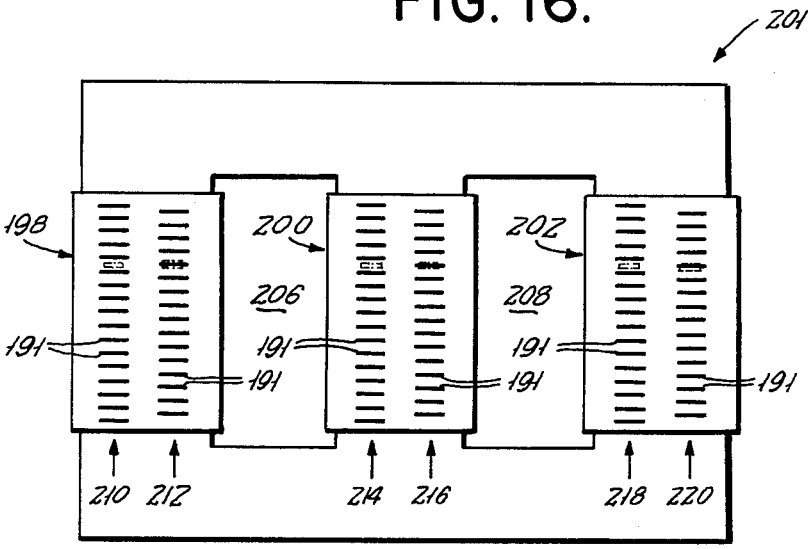
FIG. 16 is a front view of a three-phase transformer embodying the invention.

FIG. 16 shows a three-phase transformer embodiment 201 of the invention. In this embodiment, three windings 198, 200 and 202 encircle three legs of a core 204. There are two winding windows 206 and 208. As with the two winding transformer, each winding of this transformer has first and second traverse paths having segments 191 of the windings exposed therealong. Thus, winding 198 has a first traverse path 210 defined by exposed odd turns of the winding and a second traverse path 212 defined by exposed even turns of the winding. Winding 200 has a first traverse path 214 and a second traverse path 216; and winding 202 has a first traverse path 218 and a second traverse path 220. The traverse paths may be formed in any of the several ways described above and a suitable carriage carrying six brushes must also be provided.

In each of the above embodiments, the widths of the high-conductivity brushes in the direction of traversing are less than the spacings between exposed segments of the windings. Thus, no single brush is able simultaneously to come into contact with two adjacent turns, and thereby shorting of the turns through a brush is precluded. With two traverse paths along each winding, the two brushes are positioned relative to each other and relative to the exposed segments of the two traverse paths so that at all times at least one, and possibly both, of the brushes are in contact with an exposed segment of the winding. When only one brush contacts an exposed segment, only that brush provides an emf through its lead 106 to the output circuit. And when each brush contacts a respective exposed segment of the winding, the segments being at different potentials, both brushes are connected to an electrical output through a voltage offsetting electrical compensating means to be described.

A preferred voltage offsetting circuit means 203 for compensating for the differential in voltage occurring at the respective brushes is shown in FIGS. 17A through 17D. These drawings show a series of schematic circuit diagrams illustrating various positions of the first and second brushes relative to exposed segments of the winding along first and second traverse paths.

The voltage differential offsetting circuitry 203 shown in FIGS. 17A through 17D comprises pairs of parallel diodes connected in front-to-back relationship to each brush lead 106 to pass ac current from the brushes 214 and 220. Diodes 210 and 212 are connected between a first brush 214 and an output lead 215. Diodes 216 and 218 are connected in parallel front-to-back between the lead 106 from the second brush 220 and the output lead 215.

Figure 17A:
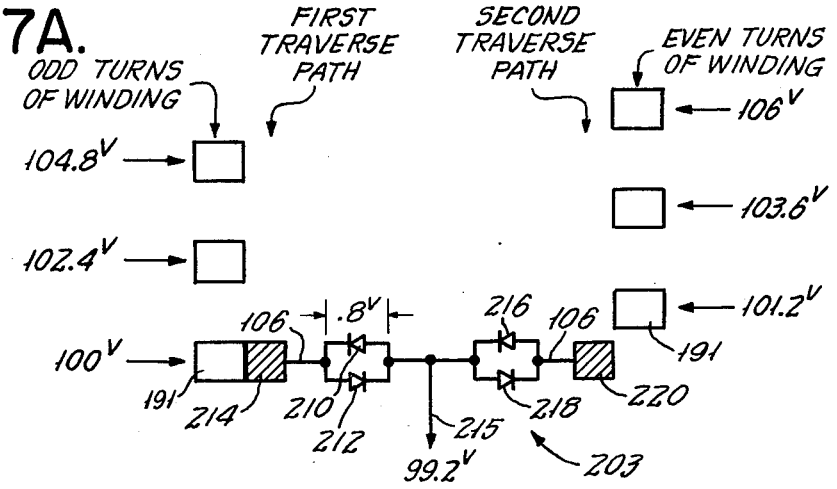
FIGS. 17A through 17D are schematic circuit diagrams including voltage offsetting circuitry and illustrating the outputs of any of the variable transformer windings of FIGS. 2 through 15, with several positions of the high-conductivity brushes relative to exposed segments of the windings being illustrated in the successive drawings of FIGS. 17A through 17D.

Each of FIGS. 17A through 17D illustrate a different position of the first and second brushes 214 and 220 relative to the respective exposed segments 191 of the odd and even turns of a winding along first and second traverse paths. In FIG. 17A, the brush 214 is aligned in contact with an exposed segment 191 of an odd turn, and the brush 220, positioned between two even turns, is not in electrical contact with an exposed segment. In this position, the diodes 210 and 212 provide a voltage drop, for example of 0.8 volts. Thus, with the r.m.s. (root mean square) voltage levels of the respective exposed segments 191 as indicated, the output on lead 215 has an r.m.s. voltage of 100 volts minus 0.8 volts or 99.2 volts.

Figure 17B:
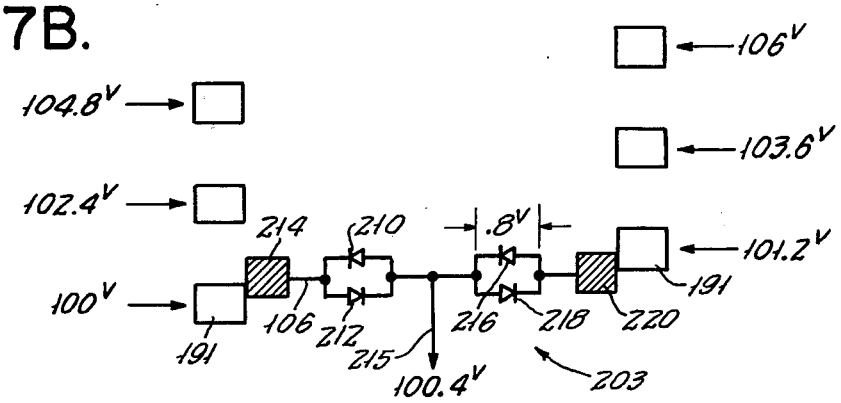

If the brushes are then moved to traverse their respective traverse paths, they can be positioned relative to the exposed segments 191 as shown in FIG. 17B wherein the brushes 214 and 220 simultaneously are in contact with the exposed segments 191 of adjacent turns. Since the turn-to-turn voltage is less than the voltage drops of the two sets of diodes 210, 212 and 216, 218 in series, no turn-to-turn current can flow through the external circuit means 203, irrespective of the load conditions on the output lead 215.

In other words, the voltage compensating circuit 203 should provide a turn-on voltage higher than the turn-to-turn voltage of the winding, and then no turn-to-turn current can flow through the external circuit means 203.

In the position shown in FIG. 17B, current flows to the load from the higher 101.2 volt potential of the contacted even turn to the output line 215. With the 0.8 volt voltage drop occurring across diodes 216 and 218, the output on lead 215 is at 100.4 volts. Although the brush 214 is in contact with an exposed segment 191 of an odd turn, that odd turn is at 100 volts, namely 0.4 volts less than the output on lead 215. Since the diodes 210 and 212 have a turn-on voltage greater than this differential of 0.4 volts, these diodes do not permit current to flow between the output lead 215 and the brush 214. Therefore, the brush 214 is effectively isolated from the output 215 by diodes 210 and 212, and thus there is no short-circuit current flow between the odd and even turns. Accordingly, this diode circuit offsets (or compensates for) the potential difference between the odd and even turns and thereby prevents any short-circuit current from flowing.

Figure 17C:
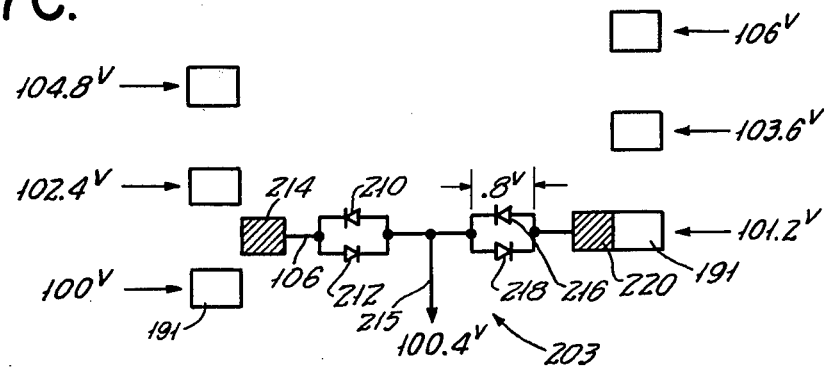

If the brushes move along the respective traverse paths into the positions shown in FIG. 17C, only the second brush 220 is in electrical contact with the exposed segments 191 of the even turn of the winding. Thus, the output is equal to the 101.2 volts of the contacted even turn minus the 0.8 volt voltage drop across diodes 216 and 218, thereby still providing an output voltage of 100.4 volts.

Figure 17D:
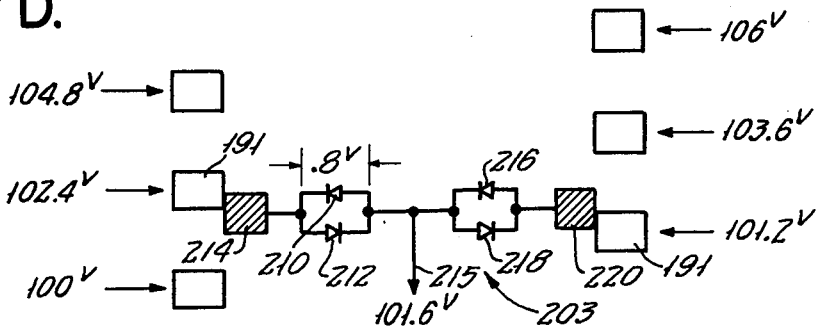

FIG. 17D shows a position of the brushes where both brushes again contact the respective exposed segments 191 of the winding, but the first brush 214 is at a higher potential than the second brush 220. In this case, the diodes 210 and 212 provide a 0.8 volt voltage drop from the 102.4 volts of the contacted odd turns, thus giving a 101.6 volt output. This 101.6 volts is only 0.4 volts greater than the 101.2 volts at the brush 220, and that voltage difference is insufficient for turning on the diodes 216 and 218. Therefore, no short-circuit current can flow.

Although only four positions of the first and second brushes relative to the first and second traverse paths of a winding have been shown, each of the various possible positions of the brushes relative to the exposed segments of the entire winding can be analyzed in accordance with one of the positions shown in FIGS. 17A through 17D. In any position of the brushes, an output is provided on line 215. And, due to the voltage offsetting provided by the voltage offsetting circuitry 203 including the two pairs of diodes, no turn ever becomes short circuited.

It should be noted that the voltage levels at the exposed segments of the even turns along the second traverse path need not necessarily be at mid-voltage between the voltage levels of odd turns along the first traverse path. For example, in embodiments where the traverse paths are along opposite faces of the transformer winding, the exposed segments of the even turns are not spaced by integral turns from the exposed segments of the odd turns of the first traverse path. Rather, the segments on the second traverse path are spaced $\frac{1}{2}$ and $1\frac{1}{2}$ turns from the next lower and higher voltage level segments along the first traverse path. With the exposed segments spaced at other than integral turns, the voltage steps of the output may change somewhat; however, the brushes can still be positioned relative to each other and relative to the exposed segments such that at all times at least one brush contacts an exposed segment, and the voltage offsetting circuitry can be selected to prevent any short circuiting of the turns.

Figure 18A:
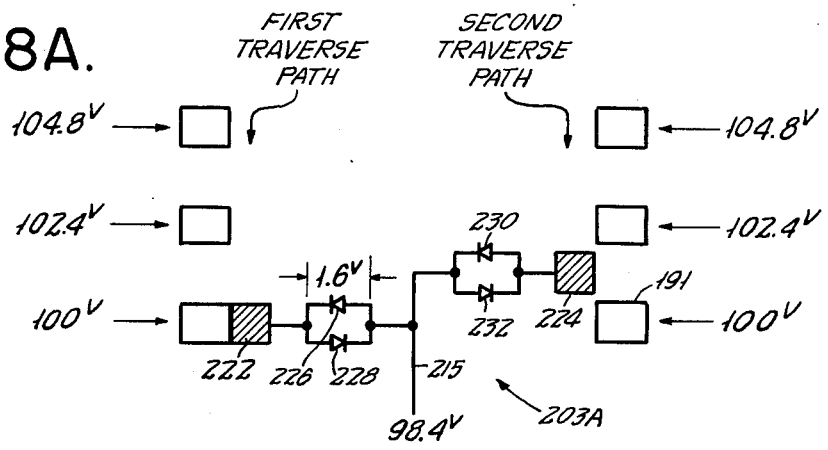
FIGS. 18A through 18D are schematic circuit diagrams illustrating a different voltage-step alternative to the embodiments of FIGS. 1 through 16.

It is not even necessary for each turn of the winding to be exposed. For example, a schematic circuit diagram illustrating a possible alternative embodiment of the invention is shown in FIGS. 18A through 18D. In this embodiment, every other turn of the winding is exposed along a first traverse path as before. There is also a second traverse path adjacent the first and the same respective turns of the winding are also exposed along the second traverse path as along the first traverse path. Thus the voltage levels along each traverse path are substantially the same. The first and second brushes 222 and 224 can still be positioned relative to each other so that at least one of the brushes at all times contacts an exposed segment 191 of the winding as the brushes traverse the winding, as illustrated in FIGS. 18A through 18D. When the brush 222 is aligned with an exposed segment 191 of the first traverse path as shown in FIG. 18A the brush 224 does not contact an exposed segment. A voltage drop, for example, of approximately 1.6 volts is provided by diodes 226 and 228 of the voltage offsetting circuit 203A (each of those diodes may actually be two diodes in series to provide the 1.6 volt voltage drop). The output on lead 215 in that position shown in FIG. 18A is thus 98.4 volts.

Figure 18B:
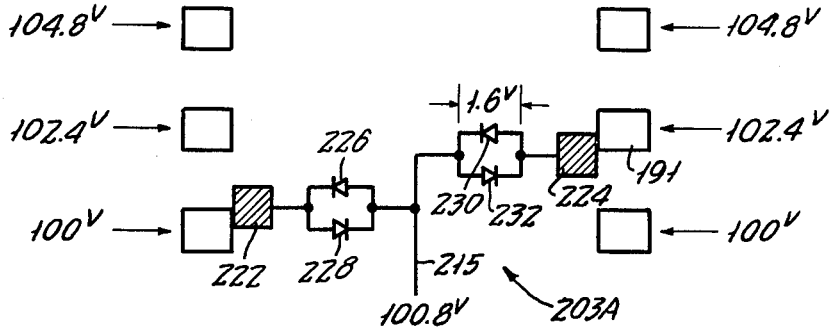

With each of the brushes partially contacting respective exposed segments 191 as shown in FIG. 18B, the diodes 230 and 232 provide a 1.6 volt voltage drop from the second brush 224 which is at 102.4 volts. The output on lead 215 is thus 100.8 volts, and the voltage difference between the output and the exposed segment 191 contacted along the first traverse path is less than that which is required to turn on the diodes 226 and 228. Accordingly, no short-circuit current can flow.

Figure 18C:
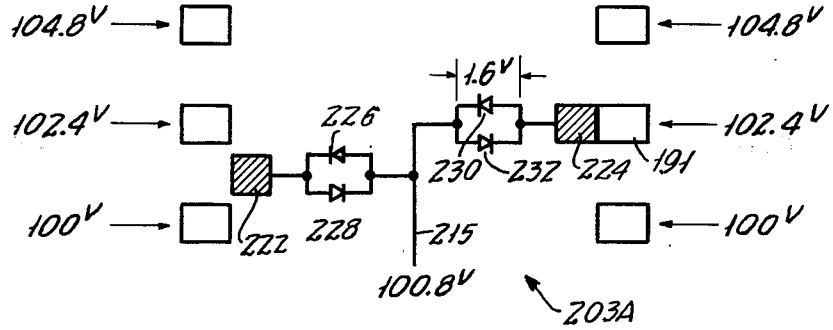
Figure 18D:
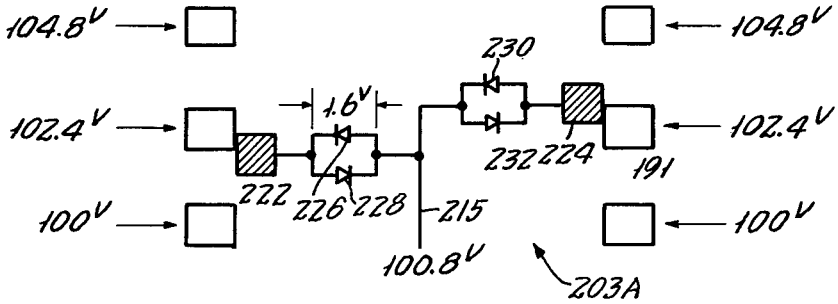

With the brushes 222 and 224 moved further along the first and second traverse paths to the position shown in FIG. 18C, only brush 224 contacts an exposed segment 191 of the winding, and the output voltage remains at 100.8 volts. Finally, with the brushes 222 and 224 again each contacting exposed segments 191 of the winding at equal potentials as shown in FIG. 18D, the 1.6 volt drop across each pair of diodes 230 and 232 again provides a 100.8 volt output.

Although the embodiment of FIGS. 18A through 18D provides only half the number of voltage steps available in other embodiments, i.e. it provides only one-half of the resolution as is obtained in accessing contact with odd turns and with even turns along the respective traverse paths, this embodiment of FIGS. 18A–D does permit simplification of the manufacturing process since the first and second traverse paths can, in effect, be merged to a common dual path having twice as much width. Every other turn along this dual traverse path is depressed. If a narrower dual traverse path is desired, then the brushes may be positioned vertically in line with each other but separated one from the other.

Figure 19:
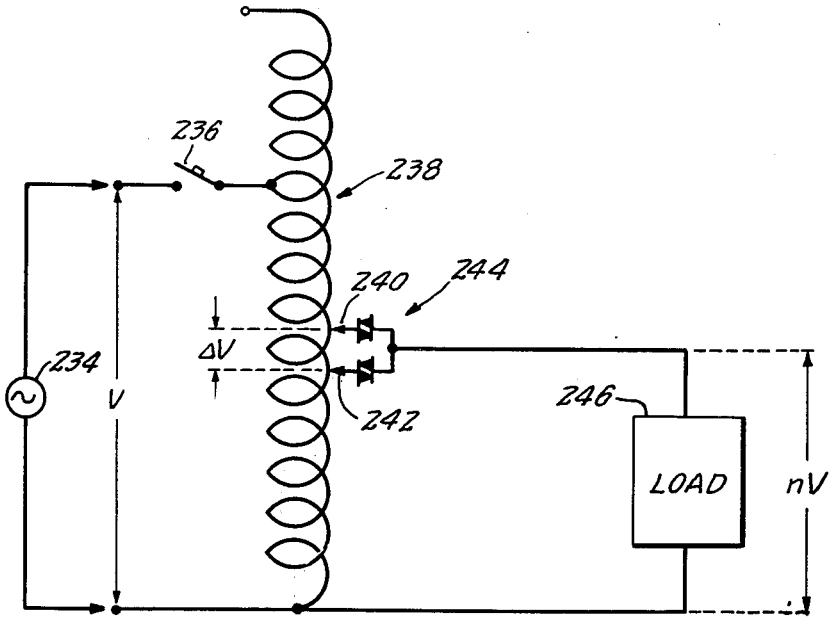
FIG. 19 is a schematic circuit diagram of a single winding autotransformer embodying the invention, for example, such as a toroidal transformer as shown in FIGS. 11 through 15.
Figure 20:
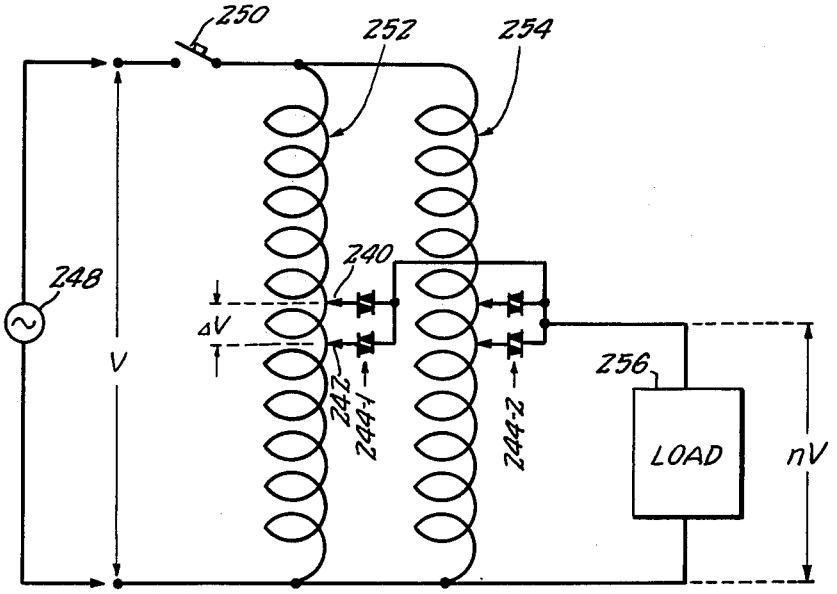
FIG. 20 is a schematic circuit diagram of a dual-winding autotransformer embodying the invention, for example, such as the transformer shown in FIGS. 1 through 5.

FIGS. 19 and 20 are electrical circuit diagrams for a single winding autotransformer (FIGS. 11 through 15) and for a dual winding autotransformer (FIGS. 2 through 6), respectively. In FIG. 19, an ac voltage V is applied from a source 234 through a switch 236 across a major portion of the winding 238. The two high-conductivity brushes 240 and 242 may be moved along the entire length of the winding. Whenever both brushes simultaneously contact exposed segments of the winding 238, there is a voltage differential $\Delta V$ between the two brushes. This voltage difference is offset by the diode circuitry 244, and the output voltage is applied across a load 246. Thus, no turn-to-turn short circuit current can flow. The voltage nV across the load 246 is approximately equal to the effective turns ratio of the autotransformer times the input voltage V.

In the dual winding autotransformer of FIG. 20, an ac voltage V is applied from a source 248 through a switch 250 to two parallel windings 252 and 254. Each winding is tapped by first and second brushes connected in circuit with voltage offsetting diode circuitry 244-1 and 244-2. The diode outputs are connected in common to provide a single output voltage of nV volts across the load 256.

The present invention is advantageously applicable to a ferro-resonant type voltage regulating transformer to provide continuous adjustment of output voltage.

Figure 21:
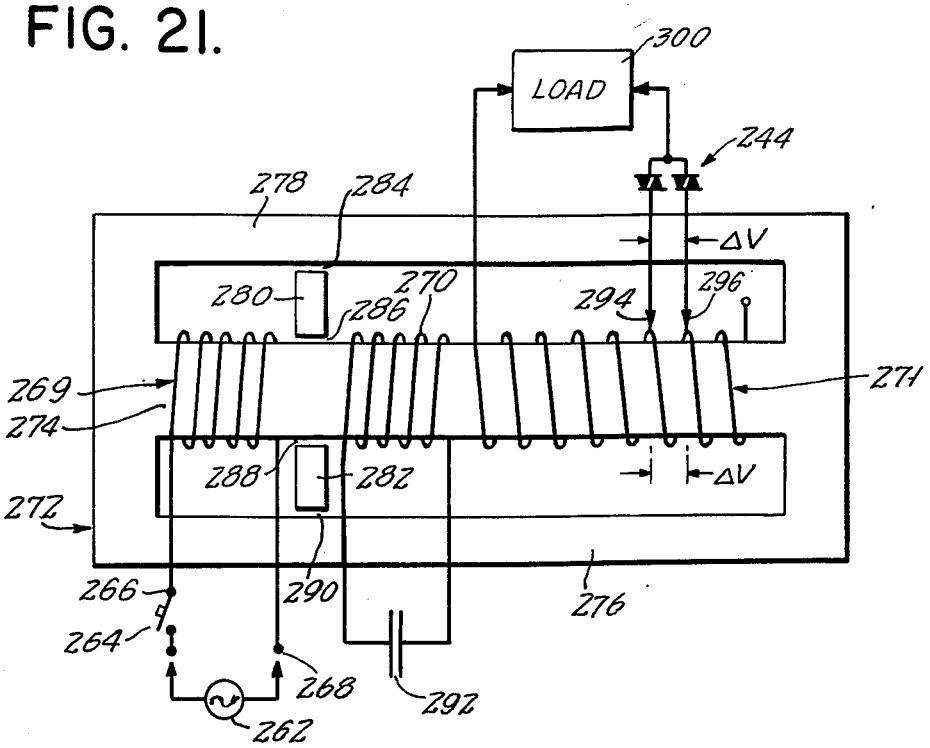
FIG. 21 is a schematic diagram of a ferro-resonant voltage regulating transformer embodying the invention.

As shown in FIG. 21, an ac potential, which may be supplied from a fluctuating, poorly regulated ac source 262, such as from an ac power line, is applied through a switch 264 to input terminals 266 and 268. The current is applied to a primary winding 269 encircling the center leg 274 of a magnetically permeable core structure 272. With the center leg 274, the outer legs 276 and 278 provide a magnetic loop through a ferro-resonant winding 270 and a secondary winding 271. Magnetically permeable shunts 280 and 282 each provide at least one air gap; four air gaps 284, 286, 288 and 290 being shown.

A capacitor 292 is connected in series with the winding 270, and this winding 270 and the capacitor 292 resonate at the input frequency, such as 60 Hertz, and thereby serve to saturate the iron. The output potential across the entire secondary or working winding 271 is limited by the magnetic saturation of the iron core. Thus, a relatively constant output voltage irrespective of changes in the input voltage source 262 is provided across any portion of the working winding 271. As before, the output is taken from two brushes 294 and 296 through a voltage difference offsetting circuit 244. The output is applied across a load 300.

Figure 22:
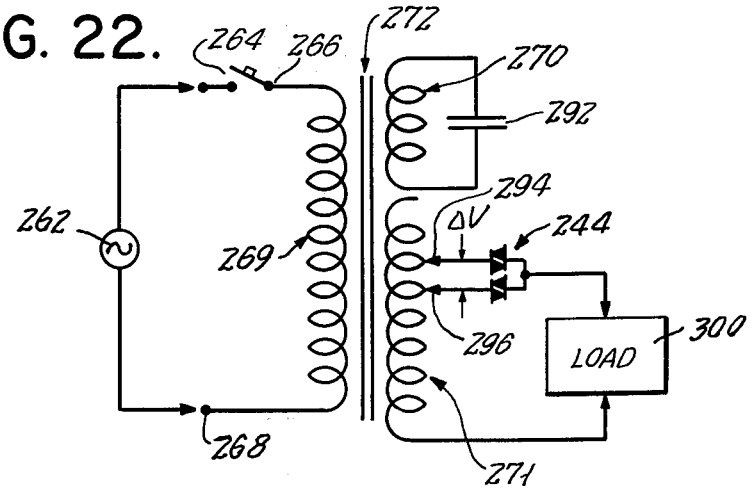
FIG. 22 is a schematic circuit diagram of the ferro-resonant transformer of FIG. 21.

An electrical schematic diagram for the ferro-resonant transformer of FIG. 21 is shown in FIG. 22.

Figure 23:
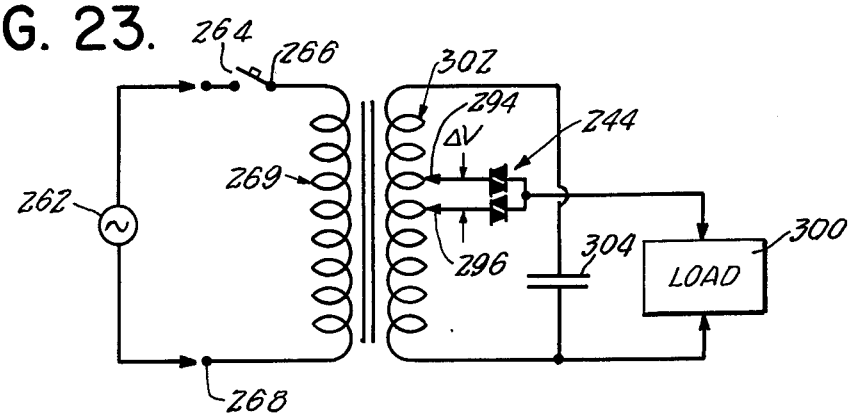
FIG. 23 is a schematic circuit diagram of an alternative ferro-resonant transformer embodying the invention.

FIG. 23 shows an alternative ferro-resonant transformer in which the working winding 302 is connected in series with a capacitor 304 to serve as the ferro-resonant winding. As before, the output is taken through an offsetting circuit 244 and applied across a load 300.

In each of the above embodiments, two high-conductivity brushes are movable along respective traverse paths along a transformer winding. Because at least one of the brushes is always in contact with the winding, an output is provided continuously even as the brushes traverse the winding. The prior art requirements for carbon brushes and loose coupling of the winding and core are avoided because no turns are ever short circuited through the high-conductivity brushes.

In FIGS. 2 through 6 and in FIG. 8, the carriage means for the high-conductivity brushes is shown being moved by a feed screw. In FIGS. 11 through 13, the carriage means for the brushes is shown being moved by a rotatable shaft. It is to be understood that the brush carriage means may be moved by any suitable mechanism.

If desired, the voltage-compensating circuit 203 (FIGS. 17A–D) or 203A (FIGS. 18A–D) or 244 (FIGS. 19 through 21) may be replaced by a center-tapped transformer. However, it is preferred to employ the diode circuit as shown because no turn-to-turn current can flow through such a circuit when the circuit is arranged to provide a turn-on voltage across the two sets of diodes in series which is greater than the turn-to-turn voltage.

As a result of experimenting with the various winding configurations, I have tentatively decided that the best mode for fabricating the winding is to employ a dielectric support with a ridge to provide a winding configuration with a raised region, such as shown in FIG. 9 or 15. This configuration with a raised region between the two sloping traverse paths facilitates keeping the exposed winding segments straight and parallel with each other along the respective traverse paths.

Among the further advantages of the present invention are those resulting from the fact that it makes very large size variable transformers feasible. For example, it now becomes practical to construct a variable transformer having a rating of 1,000 KVA or even larger.

While the invention has been particularly shown and described with reference to preferred embodiments thereof, it will be understood by those skilled in the art that various changes in form and details may be made therein without departing from the spirit and scope of the invention as defined by the appended claims.

I claim:

1. A variable transformer comprising:

a core of magnetically permeable material defining at least one loop for magnetic flux to follow, at least one electrical winding encircling at least a portion of said core, said winding including a plurality of turns, segments of respective turns of said winding being electrically exposed along its length, with dielectric material filling the spacings between adjacent exposed segments, a first brush of high electrical conductivity, a second brush of high electrical conductivity, means for traversing said first brush along a traverse path past said exposed segments of said winding and for traversing said second brush along a traverse path past said exposed segments of said winding, the spacings between adjacent exposed segments of said winding along the traverse path of said first brush being greater than the width of said first brush along that traverse path for preventing said first brush from simultaneously contacting two exposed segments, the spacings between adjacent exposed segments of said winding along the traverse path of said second brush being greater than the width of said second brush along that traverse path for preventing said second brush from simultaneously contacting two exposed segments, said first and second brushes being so positioned with respect to each other and with respect to said exposed segments of said winding along the respective traverse paths that at all times at least one of said brushes contacts an exposed segment of said winding when said brushes traverse said winding, output connection means for being connected to an electrical load, first electrical circuit means connected between said first brush and said output connection means for feeding electrical current between said first brush and said output connection means, second electrical circuit means connected between said second brush and said output connection means for feeding electrical current between said second brush and said output connection means, and said first and second electrical circuit means offsetting the voltage differential between two exposed segments of said winding when the two exposed segments are being simultaneously contacted by said first and second brushes, respectively, for electrically isolating said first and second brushes from each other for preventing electrical current from flowing between said brushes, whereby the flow of short-circuit current through any turn of the winding is prevented when the first and second brushes are simultaneously contacting two exposed segments of the winding, but nevertheless current is conducted from one of said brushes through one of said electrical circuit means to said output connection means for supplying current to an electrical load.

2. A variable transformer as claimed in claim 1 wherein the turns of said winding are closely coupled to said core.

3. A variable transformer as claimed in claim 1, wherein said first electrical circuit means comprises a first pair of parallel connected diodes between said first brusn and said output connection means, said parallel connected diodes being reversed in polarity, and said second electrical circuit means comprises a second pair of parallel connected diodes between said second brush and said output connection means, said parallel connected diodes being reversed in polarity, and the turn-on voltage of the diodes in said first and second circuit means is greater than said differential in voltage between two exposed segments being simultaneously contacted by said two brushes for preventing flow of short-circuit current in any turn of the winding.

4. A variable transformer as claimed in claim 1, in which: a dielectric support is positioned between said winding and said core, said dielectric support defining a longitudinally extending ridge with longitudinally extending channels on opposite sides of said ridge, segments of the winding which are not electrically exposed being depressed into the respective channels relative to said exposed segments for providing respective traverse paths extending parallel to each other and being laterally spaced one from the other, being located on opposite sides of said ridge, and said dielectric material covering said depressed segments.

5. A variable transformer as claimed in claim 4, in which: said ridge of the dielectric support is raised and the exposed segments of the winding slope downwardly on opposite sides of said ridge in the regions of the respective traverse paths.

6. A variable transformer as claimed in claim 4, in which: segments of odd turns of the winding are electrically exposed along one traverse path, and segments of even turns of the winding are electrically exposed along the other traverse path.

7. The method of varying the effective number of turns in electromagnetic apparatus comprising the steps of:

providing a core of mangetically permeable material for defining at least one loop for magnetic flux to follow;

providing at least one electrical winding encircling at least a portion of said core and having a plurality of adjacent turns of insulated wire electromagnetically coupling with said flux loop;

elevating every odd turn of said insulated wire of said winding along a first traverse path;

elevating every even turn of said insulated wire of said winding along a second traverse path spaced laterally from said path;

removing insulation from each of the elevated wires along said first traverse path for exposing a portion of every odd turn of said winding along said first traverse path;

removing the insulation from each of the elevated wires along said second traverse path for exposing a portion of every even turn along said second traverse path;

providing first and second brushes of material of high electrical conductivity;

simultaneously traversing said first and second brushes along said first and second traverse paths, respectively, and relatively positioning said first and second brushes for fully contacting said first brush with the exposed portion of each respective one of said odd turns whenever said second brush is located intermediate the exposed portions of the respective even turns adjacent to said odd turn being contacted, and for fully contacting said second brush with the exposed portion of each respective one of said even turns whenever said first brush is located intermediate the exposed portions of the respective odd turns adjacent to said even turn being contacted; and interconnecting said first and second brushes in circuit with each other through circuit means for off-setting the voltage differential between the successive odd and even turns of said winding for compensating for the voltage differential experienced by said brushes during their traversing whenever they are both simultaneously partially engaging portions of the successive odd and even turns, by virtue of all of which the effective number of turns of said winding of said electromagnetic apparatus can be varied by such simultaneous traversing of said brushes, the resistive losses in the brushes is minimized, and short-circuiting of the turns by the high-conductivity brushes is avoided.

8. The method of varying the effective number of turns in electromagnetic apparatus as claimed in claim 7, in which:

said wire in said winding is copper; and said brushes of high electrical conductivity are copper.

9. The method of varying the effective number of turns in electromagnetic apparatus as claimed in claim 8 including the step of:

forming said high conductivity brushes from short segments of copper wire having the same cross-section as the wire in the winding.

10. The method of varying the effective number of turns in electromagnetic apparatus as claimed in claim 7, wherein:

said electrical winding is closely coupled to said magnetically permeable core.

11. In electromagnetic apparatus having at least one winding with a multiplicity of turns encircling a core of magnetically permeable material, the method of varying the effective number of turns of said winding comprising the steps of:

exposing a portion of every odd turn along a first traverse path;

exposing a portion of every even turn along a second traverse path;

providing first and second brushes of material of high electrical conductivity;

simultaneously traversing said first and second brushes along said first and second traverse paths, respectively, and relatively positioning said first and second brushes for fully contacting said first brush with the exposed portion of each respective one of said odd turns whenever said second brush is located intermediate the exposed portions of the respective even turns adjacent to said odd turn being contacted, and for fully contacting said second brush with the exposed portion of each respective one of said even turns whenever said first brush is located intermediate the exposed portions of the respective odd turns adjacent to said even turn being contacted; and interconnecting said first and second brushes in circuit with each other through circuit means for off-setting the voltage differential between the successive odd and even turns of said winding for compensating for the voltage differential experienced by said brushes during their traversing whenever they are both simultaneously partially engaging portions of the successive odd and even turns, whereby the effective number of turns of said winding of said electromagnetic apparatus can be varied by such simultaneous traversing of said brushes of high electrical conductivity without short-circuiting any turns.

12. The method of varying the effective number of turns in electromagnetic apparatus as claimed in claim 11, in which:

said wire in said winding is copper; and said brushes of high electrical conductivity are copper.

13. The method of varying the effective number of turns in electromagnetic apparatus as claimed in claim 12 including the step of:

forming said high-conductivity brushes from short segments of copper wire having the same cross-section as the wire in the winding.

14. The method of varying the effective number of turns in electromagnetic apparatus as claimed in claim 11, wherein:

said electrical winding is closely coupled to said magnetically permeable core.

15. In variable electromagnetic apparatus having a core of magnetically permeable material, at least one electrical winding encircling said core with segments of the turns of said winding being electrically exposed, the invention for varying the effective number of turns of said winding without short-circuiting any turn of said winding comprising:

insulating material filling the spaces between adjacent exposed segments of said winding, a first electrically conductive brush of metal of good conductivity, a second electrically conductive brush of metal of good conductivity, movable carriage means for simultaneously traversing said first and second brushes along first and second traverse paths, respectively, with at least one of said brushes at all times contacting an exposed segment of said winding, the spacings between adjacent exposed segments of said winding along each respective traverse path being greater than the width of the brush which is movable along said traverse path for preventing each brush from simultaneously contacting two exposed segments in its traverse path for preventing the brush from short-circuiting the winding turns, output connection means for supplying current to a load, first circuit means in circuit between said first brush and said output connection means, second circuit means in circuit between said second brush and said output connection means, said first circuit means including a first plurality of unidirectional conduction members connected in first and second parallel lines between said first brush and said output connection means, said unidirectional conduction members being reversed in polarity in said first and second lines, said second circuit means including a second plurality of unidirectional conduction members connected in third and fourth parallel lines between said second brush and said output connection means, said unidirectional conduction members being reversed in polarity in said third and fourth lines, the breakdown voltage for conduction to occur in the forward direction in series through said first and third lines exceeding the differential in voltage occurring between said brushes when segments are being simultaneously contacted by said brushes, and the breakdown voltage for conduction to occur in the forward direction in series through said second and fourth lines exceeding the differential in voltage occurring between said brushes when segments are being simultaneously contacted by said brushes.

16. In a variable electromagnetic apparatus, the invention for varying the effective number of turns of said winding without short-circuiting any turn of said winding as claimed in claim 15, in which:

said winding is closely coupled to said magnetically permeable core.

17. In a variable electromagnetic apparatus, the invention for varying the effective number of turns of said winding without short-circuiting any turn of said winding as claimed in claim 15 or 16, in which:

said exposed segments in said two traverse paths are on a different side of the winding.

18. In a variable electromagnetic apparatus, the invention for varying the effective number of turns of said winding without short-circuiting any turn of said winding as claimed in claim 15 or 16, in which:

said exposed segments in said two traverse paths are on the same side of the winding but are spaced apart laterally from each other.

19. In a variable electromagnetic apparatus, the invention for varying the effective number of turns of said winding without short-circuiting any turn of said winding as claimed in claim 15 or 16, in which:

said two traverse paths are on the same side of the winding but with a ridge between said two traverse paths for sloping the exposed segments along both of said traverse paths.

20. In variable electromagnetic apparatus having a winding of an electrical conductor with turns passing around a magnetically permeable core with means exposing a segment of every odd turn of said winding along a first traverse path and exposing a segment of every even turn of said winding along a second traverse path spaced away from said first traverse path and with movable carriage means simultaneously movable along near both of said traverse paths and with first and second brushes of high electrical conductivity mounted on said carriage means for traversing said first and second brushes along said first and second traverse paths, respectively, for coming into contact with the respective exposed turns along each of said paths, the invention for varying the effective number of turns of said winding without short-circuiting any turn of said winding comprising:

the spacings between exposed segments of said odd and even turns respectively being greater than the width of the brushes and said first and second brushes being relatively positioned on said carriage means for fully contacting said first brush with an exposed segment of an odd turn when said second brush is between the even turns and for fully contacting said second brush with an exposed segment of an even turn when said first brush is between the odd turns for preventing either of the brushes from short circuiting any of the turns;

output connection means for supplying current to a load;

first circuit means in circuit between said first brush and said output connection means;

second circuit means in circuit between said second brush and said output connection means;

said first circuit means including a first plurality of unidirectional condution members connected in first and second parallel lines between said first brush and said output connection means;

said unidirectional conduction members being reversed in polarity in said first and second lines;

said second circuit means including a second plurality of unidirectional conduction members connected in third and fourth parallel lines between said second brush and said output connection means;

said unidirectional conduction members being reversed in polarity in said third and fourth lines;

the breakdown voltage for conduction to occur in the forward direction in series through said first and third lines exceeding the differential in voltage occurring between said brushes when exposed segments of odd and even turns are being simultaneously contacted by said brushes; and the breakdown voltage for conduction to occur in the forward direction in series through said second and fourth lines exceeding the differential in voltage occurring between said brushes when exposed segments of odd and even turns are being simultaneously contacted by said brushes, whereby the flow of short-circuit current through any turn of the winding is prevented when the first and second brushes are simultaneously contacting exposed segments of odd and even turns of the winding, but nevertheless in varying the effective number of turns of said winding current is always conducted from one of said brushes through one of said electrical circuit means to said output connection means for supplying current to an electrical load.

21. In a variable transformer having a core of magnetically permeable material, at least one electrical winding encircling said core with segments of the turns of said winding being electrically exposed, with first and second electrically conductive brushes and with movable carriage means for simultaneously traversing said first and second brushes along first and second traverse paths, respectively, with at least one of said brushes at all times contacting an exposed segment of said winding and wherein the spacings between adjacent exposed segments of said winding along each respective traverse path are greater than the width of the brush which is movable along said traverse path for preventing a brush from simultaneously contacting two exposed segments on its traverse path for preventing each brush itself from short-circuiting the winding turns, the invention for varying the effective number of turns of said winding comprising:

insulating material filling the spaces between adjacent exposed segments of said winding along each of said traverse paths;

an output terminal adapted to be connected to a load;

a first circuit between said first brush and said output terminal;

a second circuit between said second brush and said output terminal;

said first circuit including first and second lines of unidirectional conduction devices in parallel with the polarity of the unidirectional conduction devices in the first and second lines being reversed;

said second circuit including third and fourth lines of unidirectional conduction devices in parallel with the polarity of the unidirectional conduction devices in the third and fourth lines being reversed;

the turn-on voltage of all of the unidirectional conduction devices in the first and third lines in series between said brushes being greater than the differential in potential of said brushes when they are both contacting exposed segments of said winding; and the turn-on voltage of all of the unidirectional conduction devices in the second and fourth lines in series between said brushes being greater than the differential in potential of said brushes when they are both contacting exposed segments of said winding;

thereby preventing short-circuit current from flowing at any time between said brushes while enabling output current to be supplied from said winding to said output terminal in all positions of said carriage means.

* * * * *